United States Patent [19]

Keller et al.

[11] 4,283,909

[45] Aug. 18, 1981

[54] SPINDLE CLEANING APPARATUS

[75] Inventors: Alex J. Keller, Clover; Thad Flowers, Fort Mill, both of S.C.; Joseph R. Williams, Kings Mountain, N.C.; Navinchandra K. Patel, Houston, Tex.

[73] Assignee: Automatic Material Handling, Inc., Bessemer City, N.C.

[21] Appl. No.: 168,333

[22] Filed: Jul. 14, 1980

Related U.S. Application Data

[63] Continuation-in-part of Ser. No. 62,992, Aug. 2, 1979, abandoned.

[51] Int. Cl.[3] ..... D01H 11/00

[52] U.S. Cl. ..... 57/306

[58] Field of Search ..... 57/299, 300, 303, 304, 57/306; 15/256.5; 242/18 EW, 18 PW

[56] References Cited

U.S. PATENT DOCUMENTS

| | | | |
|---|---|---|---|
| 2,932,149 | 4/1960 | Ingham | 57/306 |
| 3,631,663 | 1/1972 | Krauss et al. | 57/303 X |
| 3,778,996 | 12/1973 | Olson et al. | 57/299 X |
| 3,782,094 | 1/1974 | Flowers | 57/306 |
| 4,151,706 | 5/1979 | Brooks | 57/299 X |

FOREIGN PATENT DOCUMENTS

| | | | |
|---|---|---|---|
| 2708553 | 8/1978 | Fed. Rep. of Germany | 57/306 |

*Primary Examiner*—Donald Watkins
*Attorney, Agent, or Firm*—Richards, Shefte & Pinckney

[57] ABSTRACT

For use with a spinning frame, apparatus for removing underwound yarn wraps from the base portion of the rotating spindle, such apparatus including a spindle cleaning structure mounted on a spindle rail for pivotal movement between a first spindle cleaning position engaging the spindle and a second inactive position clear of the movement of the reciprocating ring rail of the spinning frame. A plurality of spindle cleaning structures may be provided along the extent of the spindle rail, each such structure being operated between its first and second position by the movement of ring rail during a predetermined portion of such movement. The spindle cleaning structures may be arranged for sequential operation by the ring rail to provide sequential cleaning of the spindles.

18 Claims, 6 Drawing Figures

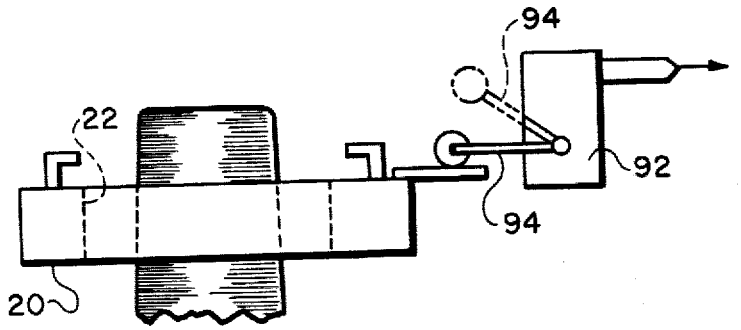
FIG.5A
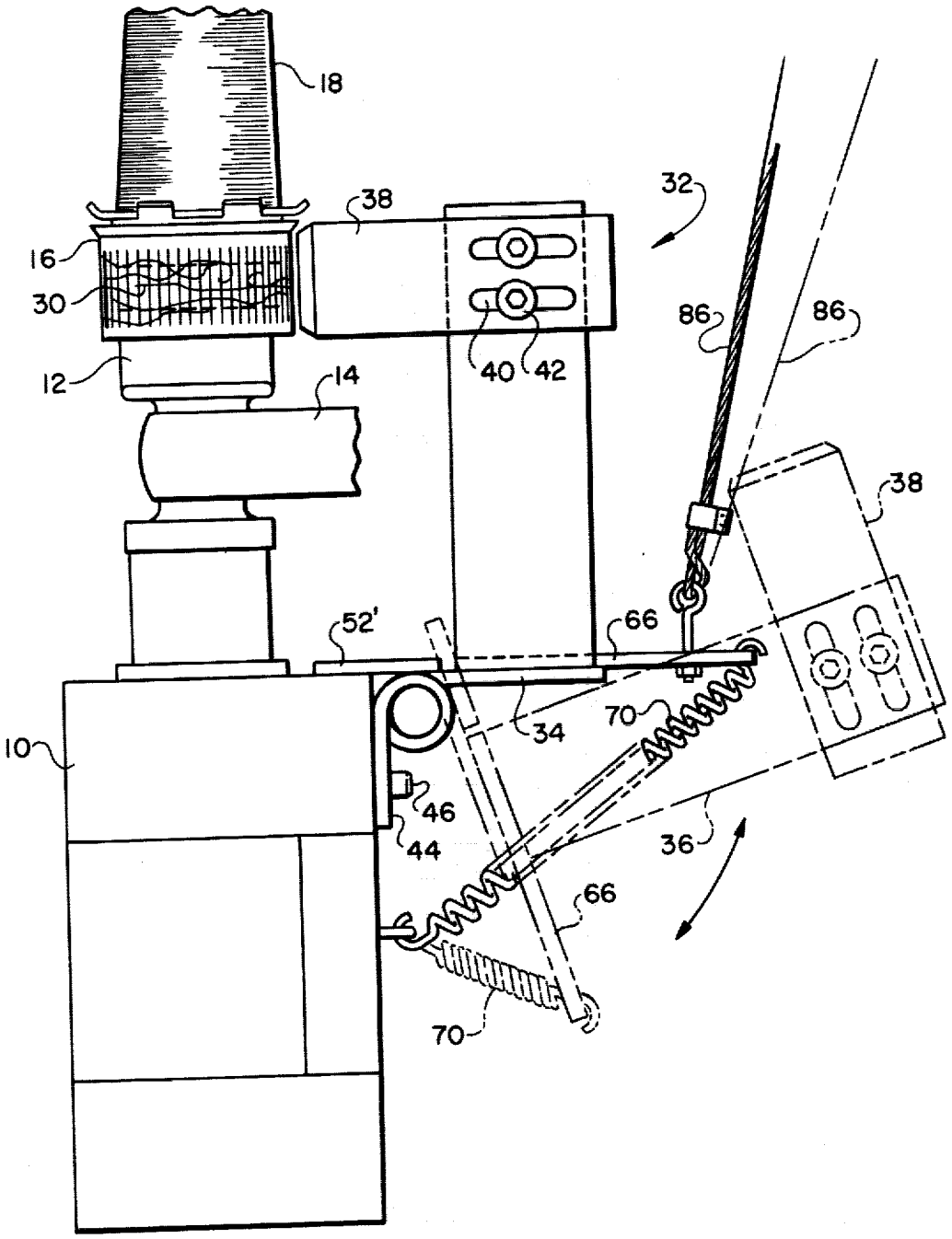

SPINDLE CLEANING APPARATUS

RELATION TO OTHER APPLICATIONS

This is a continuation-in-part of U.S. patent application Ser. No. 62,992, filed Aug. 2, 1979, and now abandoned.

BACKGROUND OF THE INVENTION

As is well known in the art, spinning frames are used to build yarn packages on bobbins carried on rotating spindles of the spinning frame, such yarn being fed to the bobbins by a ring rail reciprocating along the axes of the bobbins and spindles. After the yarn package is built on the bobbin, the reciprocating ring rail is lowered to a position beneath the lowest extent of bobbins to cause a plurality of yarn wraps to be wound about a specially roughened lower surface of the spindle itself, sometimes referred to as "bottomwinding", these yarn wraps serving to hold the ends of yarn in place on the spindle during doffing of the full bobbin whereby the yarn will break during doffing.

To facilitate this breaking of the yarn where the full bobbins are automatically doffed, the lower portion of the spindle is usually provided with an outwardly extending cutter edge configuration located just above the aforesaid roughened lower surface of the spindle upon which the yarn wraps are laid, and as the full bobbins are doffed from the spindles the yarn is tensioned across the cutter edge configuration and severed thereby; a typical spindle construction of the aforementioned type is disclosed in Winter U.S. Pat. No. 3,210,922.

It will be apparent that each time a bobbin is doffed from the spindle, a plurality of yarn wraps remain on the lower portion of the spindle, and these yarn wraps will accumulate, unless removed, as a number of doffing cycles are completed. Excessive accumulation of these yarn wraps can have serious adverse consequences. For example, if the accumulation of yarn wraps is uncontrolled, the build-up may increase the effective diameter of the lower portion of the spindle to a point that the yarn wraps extend outwardly beyond the diameter of the cutter edge configuration on the spindle whereby insufficient tension is imposed on the yarn across the cutter edge configuration, and the yarn may not be severed by the cutter edge configuration during doffing of the bobbin.

Accordingly, devices for cleaning the yarn wraps from spindles have heretofore been developed to overcome the aforementioned problems of uncontrolled yarn wrap accumulation. For example, Winter U.S. Pat. No. 3,426,518 and Jones U.S. Pat. No. 3,263,407 both disclose hand-operated yarn wrap cleaners designed to be selectively mounted on the spindle rail of a spinning frame for movement therealong, these cleaners including cleaning elements which engage the lower portions of the rotating spindles as the cleaners are manually pushed along the spindle rail. More sophisticated yarn wrap removal devices are disclosed in Schumann U.S. Pat. No. 3,312,051 and Keller U.S. Pat. No. 4,133,168 which provide carriage means adapted to be mounted on a rail extending along the spinning frame, this carriage means including spindle cleaning elements as well as suction apparatus to draw away the yarn wraps as they are separated from the spindle by the cleaning elements during movement of the cleaning devices along the spinning frame rail.

However, in manually operated yarn wrap cleaning devices, the labor costs are quite high and, frequently, the operating personnel do not clean the spindles as often as is necessary. As a result, the yarn wraps often accumulate to an extent that improper severing of the yarn results as described above, or to an extent that results in an excessive amount of "fly" being generated when the large accumulation of yarn wraps is eventually cleaned. In some cases, even the provision of suction apparatus with the yarn wrap cleaner will not draw away all of the "fly" because of its volume and tendency to be propagated, during removal, beyond the effective drawing power of the vacuum source. The resulting "fly" may create an unacceptable dust level in the spinning room, and may adhere to the yarn being processed so as to adversely affect the quality thereof. Thus, while the above-mentioned prior art yarn wrap cleaning devices may, if used after each doffing cycle, properly clean yarn wraps from the spindles, the labor costs required to use these devices and the difficulties required to mount the apparatus on the spinning frame often result, as a practical matter, in such equipment not being used frequently enough, thereby creating the accompanying disadvantages noted above.

Finally, in the aforementioned Schumann U.S. Pat. No. 3,312,051, there is disclosed, in FIG. 5 thereof, a permanently installed vacuum system having spindle scraping devices associated therewith which are moved horizontally into and out of engagement with the spindles by cams. While this arrangement avoids the necessity of mounting the cleaning unit on the spinning frame each time it is used, such arrangement is cumbersome and would be relatively expensive to produce and mount on existing spinning frames. Additionally, the spinning room personnel would bear the burden of operating the equipment at regular intervals to avoid an excessive accumulation of yarn wraps on the spindles.

To avoid the foregoing drawbacks of the prior art, the present invention provides simple, inexpensive apparatus for cleaning spindles, and such apparatus may be operated automatically by the ring rail of the spinning frame to effectuate cleaning of the spindles after each doffing cycle.

SUMMARY OF THE INVENTION

In accordance with the present invention, apparatus for cleaning the underwound yarn wraps from spindles is provided for use with conventional spinning frames having a plurality of spindles extending upwardly from the spindle rail and a ring rail which reciprocates along the axes of the spindles to build yarn packages on bobbins carried by the spindle.

The apparatus includes a supporting frame having at least one spindle cleaning element mounted thereon for selective cleaning engagement with a spindle, and mounting means associated with the supporting frame to connect it to the spindle rail for movement between a first position at which the cleaning element engages the spindle for cleaning yarn wraps therefrom and a second position at which the supporting frame and cleaning element are disposed beneath the lowest point of movement of the ring rail so as not to interfere with the normal operation of the ring rail. The supporting frame is associated with the ring rail so that the supporting frame may be moved automatically between its aforesaid first and second positions in response to the reciprocating movement of the ring rail during a predetermined portion of such movement.

In one disclosed embodiment of the present invention, a mounting plate is fixed to the spindle rail and provides a pivotal connection for the supporting frame to permit pivotal movement between its first and second positions. A torsion spring urges the supporting frame to its first position, and a flexible link connects the ring rail to the supporting frame to move the supporting frame against the aforesaid spring and to its second position during a predetermined portion of movement of the ring rail. Thus, during the portion of the downward ring rail movement at which bottomwinding occurs, the supporting frame is pivoted to its second position, clear of the ring rail. As the ring rail moves upwardly, the spring pivots the supporting frame to its first position for cleaning of the spindle.

In accordance with a further feature of the present invention, a plurality of individual cleaning elements may be connected together as a group for simultaneous operation by the ring rail, and different groups may be connected to the ring rail by different connecting elements so that the different groups are operated during different portions of ring rail movement whereby all of the spindles on the spinning rail are not cleaned simultaneously and the generated "fly" at any given time is proportionately reduced for more efficient collection by the suction system normally associated with the spinning frame.

The supporting frame is designed to have individual spindle cleaning elements mounted thereon, and the location of the cleaning element with respect to the supporting frame, as well as the position of the supporting frame with respect to the spindles, may be adjusted to obtain a proper positioning of each cleaning element with respect to the spindle it cleans.

In a second disclosed embodiment of the present invention, the cleaning elements, supporting frame, and the mounting arrangement therefor are situated on the spinning frame in essentially the same manner as that of the first embodiment. However, in the second embodiment, pivoting of the supporting frame is obtained by the use of operating means that is energized in response to the reciprocating ring rail reaching a predetermined position during the package building movement thereof to cause the cleaning elements to be moved from their lower or inactive position to their raised or cleaning position. Preferably, such operating means includes a switch disposed in the path of movement of the ring rail, and a motor that is connected to the supporting frame for the cleaning elements and that is energized by the actuation of the switch to raise the supporting frame and cleaning elements to their cleaning position and maintain them there for a predetermined period of time, after which a biasing spring lowers the supporting frame and cleaning elements to their lower position.

BRIEF DESCRIPTION OF THE DRAWINGS

FIGS. 5A and 5B are side elevational views of a second embodiment of the yarn wrap cleaning devices of the present invention mounted on a conventional spinning frame.

DESCRIPTION OF THE PREFERRED EMBODIMENT

Figure 1:
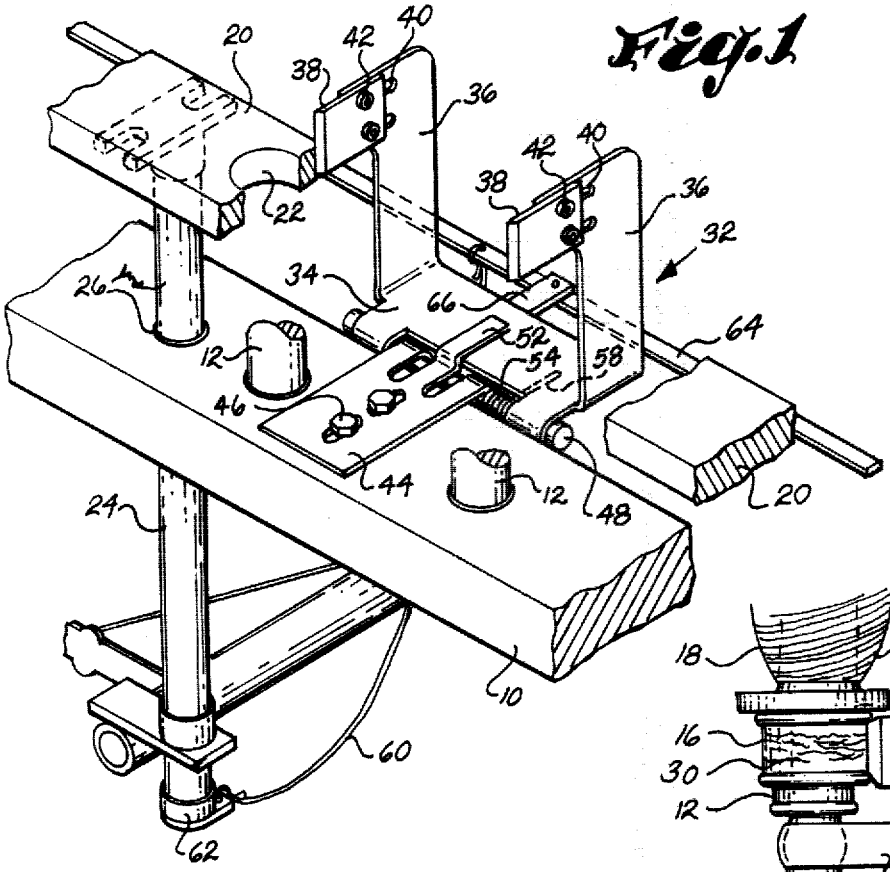
FIG. 1 is a perspective view of one embodiment of the yarn wrap cleaning device of the present invention mounted on a conventional spinning frame that is shown in part.
Figure 2:
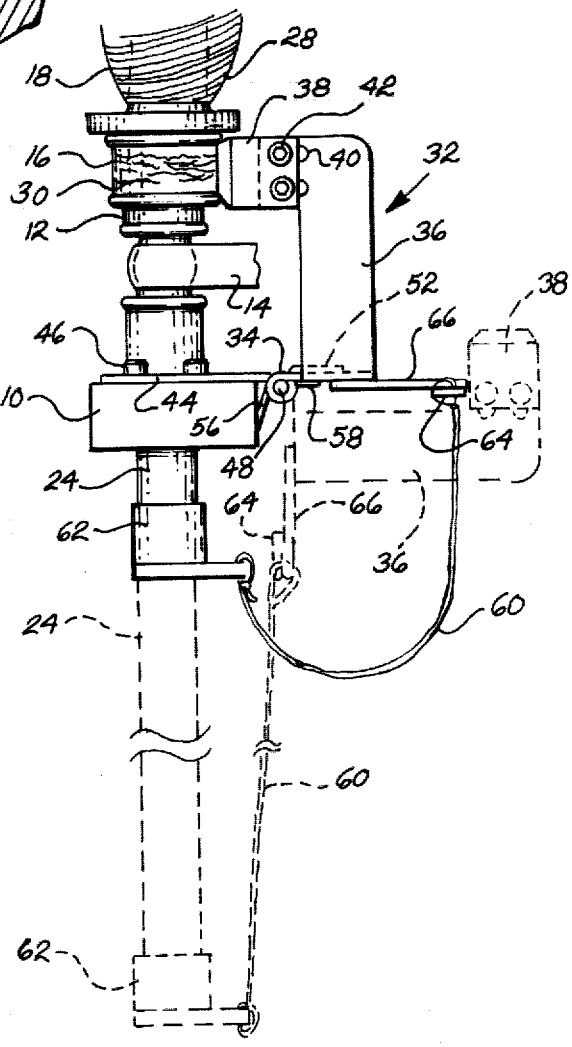
FIG. 2 is a side elevational view of a yarn wrap cleaning device illustrated in FIG. 1.

Looking now in greater detail at the accompanying drawings, FIGS. 1–4 illustrate components, partially cut-away, of a conventional spinning frame, including a spindle rail 10 which extends horizontally along the front of the spinning frame to support a plurality of horizontally spaced spindles 12 that extend upwardly from the spindle rail along parallel axes, the spindle 12 being arranged for rotation by conventional drive belts 14 (see FIG. 2). The rotating spindles 12 each include an underwinding base portion 16, and an upwardly projecting portion (not shown) on which is carried a bobbin 18 for rotation therewith. The spinning frame also includes a ring rail 20, arranged for vertical reciprocation with respect to the spindle rail 10, the ring rail 20 including a plurality of openings 22 (one of which is illustrated in FIG. 1) through which the spindles 12 and the bobbins 18 thereon extend. The vertical reciprocation of the ring rail 20 is obtained from vertical guide rods 24 that are connected to the ring rail 20 and extend downwardly therefrom, through an opening 26 in the spindle rail 10 so as to extend therebeneath.

The foregoing spinning rail components are conventional, and the operation of the spinning frame, which is well known in the art, may be briefly summarized as follows. Empty bobbins 18 are loaded on the upwardly extending portion of the spindles 12 for rotation therewith, and yarn is led to a traveler ring (not shown) at each opening 22 in the ring rail 20 and onto the bobbins 18. When the spinning frame is energized, the bobbins 18 are rotated within the openings 22 of the ring rail 20, and the ring rail 20 and guide rods 24 are reciprocated vertically along the axes of the bobbins 18 whereby a predetermined package of yarn 28 is built onto the rotating bobbins 18 by the reciprocating ring rail 20. When the building of the yarn package has been completed, the ring rail is momentarily lowered to an abnormally low position beneath the bottom portion of the bobbin at which the openings 22 in the ring rail 20 are substantially even with the base portions 16 of the rotating spindles 12 so that several underwound yarn wraps 30 are wound onto the spindle base portion 16. These yarn wraps 30, as described in further detail above, hold the end of the yarn in place on the spindle base portion 16 so that when the full bobbin is doffed, or pulled upwardly off the spindle 12, the yarn is stretched across a cutting edge so as to be severed thereby during doffing, whereupon the aforementioned spinning frame cycle is repeated. It will be appreciated that the yarn wraps 30 generally remain on the spindle base portion 16 after the bobbins 18 are doffed, and they will accumulate there, unless cleaned, in an ever increasing quantity as the number of cycles are completed, thereby creating the problems discussed above.

Figures 3, 4:
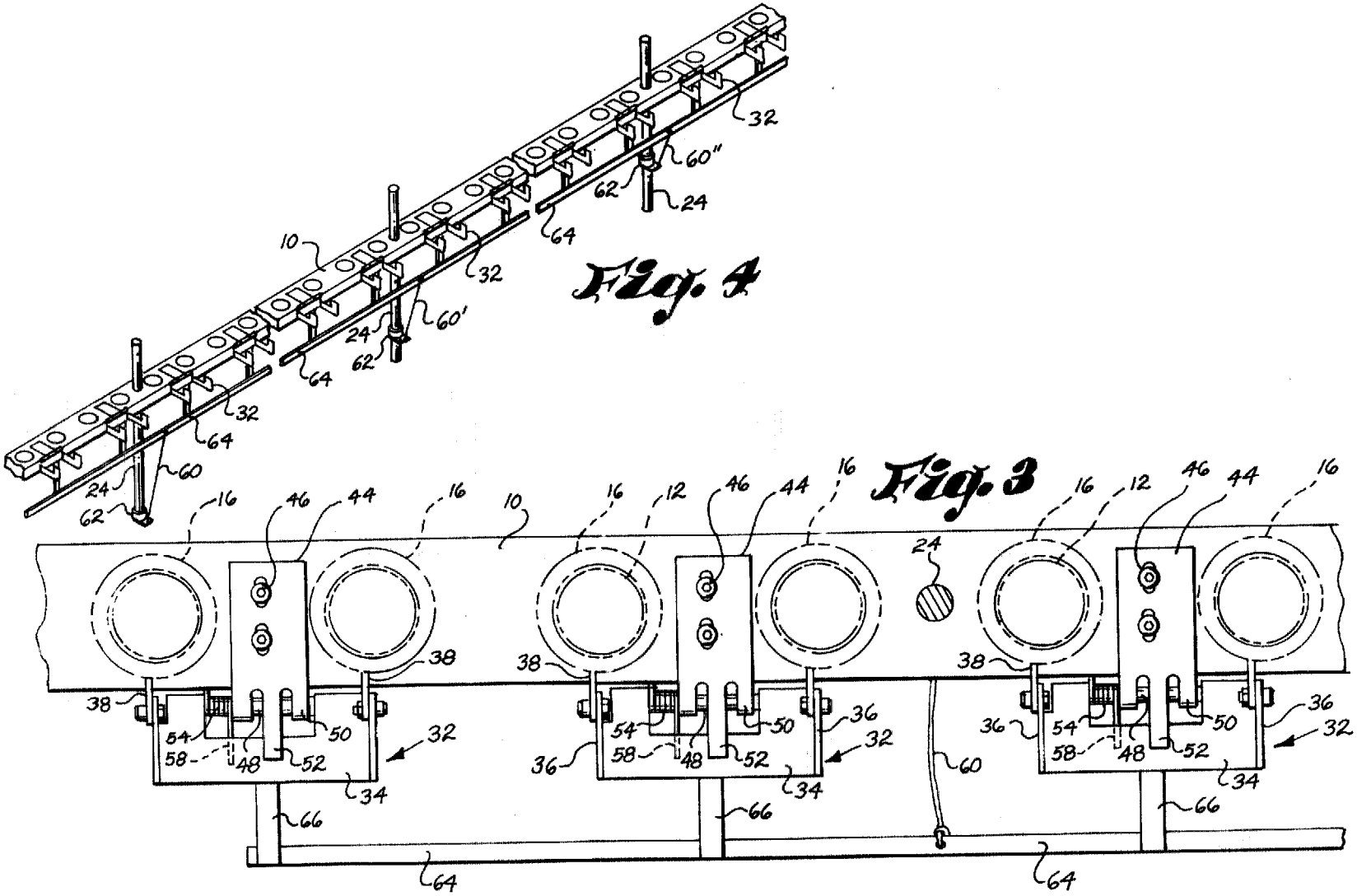
FIG. 3 is a plan view showing a plurality of spindles and the yarn wrap cleaning devices as illustrated in FIG. 1.
FIG. 4 is a diagrammatic perspective view illustrating a plurality of yarn wrap cleaning devices shown in FIG. 1 and arranged to engage spindles during different portions of the upward movement of the ring rail.

To deal with this problem presented by the accumulation of the yarn wraps 30, the present invention provides a spindle cleaning device 32 that is capable of automatically cleaning the yarn wraps 30 from the spindle base portions 16 after each doffing of full bobbins 18, one such spindle cleaning device or apparatus 32 being illustrated in FIGS. 1 and 2, and a plurality thereof being illustrated in FIGS. 3 and 4. As best seen in FIGS. 1 and 2, the spindle cleaning devices includes a supporting frame portion 34 having two upstanding arm members 36 which, in the first or cleaning position of the spindle cleaning device 32 shown in full lines, extend upwardly in generally parallel relation to the vertical axes of two adjacent spindles 12. Each arm member 36 has mounted thereon a cleaning element 38, the arm members 36 including slots 40 to receive bolts 42 to permit selective adjustment of the cleaning elements 38 in a direction transverse to the axes of the spindles 12, or in a direction toward and away from the spindle base portion 16 as best seen in FIG. 2. The supporting frame 34 is mounted on the spindle rail 10 by a mounting bracket 44 secured in place by bolts 46, the mounting bracket 44 including a horizontally extending pivot rod 48 which receives curved finger portions 50 extending from the supporting frame 34 to permit pivotal movement of the supporting frame 34 about the pivot rod 48. The mounting bracket 44 also includes a stop element 52 extending horizontally therefrom to engage the supporting frame 34 during pivotal movement thereof and prevent further upward movement of the supporting frame as will be explained in greater detail presently. Additionally, a torsion spring 54 is wrapped about the pivot rod 48 with one extending end 56 of the spring 54 being forced against the spindle rail 10 and held in place thereat (see FIG. 2), and with the other extending end 58 of the spring 54 being located beneath, and in contact with, the supporting frame 34, whereby the bias of the torsion spring 54 urges the supporting frame 34 in an upward direction toward contact with the stop element 52 so that the supporting frame 34 will normally be held at its first position as illustrated in FIG. 1.

To move the supporting frame 34 from its first or spindle engaging position (shown in full lines in FIG. 2) to its second or lower position (shown in dotted lines in FIG. 2), a flexible link 60, preferably a length of wire cable, is connected at one end thereof to a bracket 62 carried on the lower portion of the ring rail guide rod 24 and is connected at the other end thereof to a connecting element 64 that extends horizontally along and behind the spindle cleaning device 32 and that is connected to each such spindle cleaning device 32 by an extension element 66. It is to be understood that the flexible link 60 could be connected directly to the supporting frame 34 of an individual spindle cleaning device 32 for independent operation of each individual spindle cleaning device 32, but as will be described presently, it is generally preferable to have a plurality of individual spindle cleaning devices 32 operated as a group by one flexible line 60.

The basic operation of the spindle cleaning device 32 illustrated in FIGS. 1-4 can best be understood by referring to FIGS. 1 and 2. The flexible link 60 has a predetermined length selected to result in such flexible link 60 always being in a slack condition during the entire vertical range of the reciprocating movement of the ring rail 20 as it builds a package of yarn 28 on each of the bobbins 18. Because the flexible link 60 is in a slack condition, the urging of the torsion spring 54 against the bottom of the supporting frame 34 results in the spindle cleaning device 32 being maintained in its first position (shown in full lines in FIG. 2) with the cleaning elements 38 engaging the base portion 16 of the spindles 12 to clean yarn wraps 30 therefrom. Since the ring rail 20, during its package building reciprocating movement, does not move beneath the bottom end of the bobbins 18, the spindle cleaning devices 32, even at the first positions thereof, do not interfere with the operation of the ring rail 20.

After the yarn packages 28 have been built on the bobbins 18, the ring rail 20 and its guide rods 24 are lowered, either manually or automatically by the spinning frame, to an abnormally low position for bottomwinding at which the ring rail 20 is disposed with the openings 22 therein located around the base portion 16 of the spindles 12 to cause a plurality of yarn wraps 30 to be placed on the base portion 16 as described previously. The length of the flexible link 60 is selected so that it will be in a state of tension (without slack) at the point at which the ring rail 20 begins its aforesaid downward movement for bottomwinding, and the flexible link 60 will remain tensioned during the entire predetermined portion of the downward movement of the ring rail 20 during which bottomwinding is effectuated. Accordingly, during this predetermined portion of the downward movement of the ring rail 20, the flexible link 60 will pivot the supporting frame 34 downwardly about the pivot rod 48 and against the urging of the torsion spring 54 until the supporting frame 34 reaches its second or vertical position (shown in dotted lines in FIG. 2) simultaneously with the ring rail 20, and the guide rods 24 thereof, reaching its lowermost position. Thus, during the downward portion of movement of the ring rail 20 for bottomwinding, the supporting frame 34 is also pivoted downwardly to be clear of the descending ring rail 20 without interference therewith.

After the bottomwinding has been completed, the ring rail 20 and guide rods 34 will start to ascend, and the torsion spring 54 will maintain the flexible link 60 in tension while pivoting the supporting frame 34 upwardly until it reaches its first position and abuts stop element 52, at which position the cleaning elements 38 once again engage the base portion 16 of the spindle 12 to clean the yarn wraps therefrom.

To provide a proper engagement between the cleaning elements 38 and the spindle base portions 16, the present invention provides two adjustment features. First, the slots 40 and bolts 42 permit the cleaning elements 38 to be adjusted selectively in a direction transverse to the spindle axes, or toward and away from the spindle base portion 16. Additionally, since the stop element 52 extends outwardly from the mounting bracket 44 as illustrated in FIGS. 1 and 2, it can be readily bent upwardly or downwardly to adjust the point at which the supporting frame 34 abuts or engages the stop element 52 and thereby selectively vary the degree of contact between the cleaning elements 38 and the spindle base portion 16.

As indicated above, the spindle cleaning device 32 shown in FIGS. 1-4 can be operated individually or in groups, depending on whether each such device is individually connected to a flexible link 60, or collectively connected to a flexible link 60 in groups by utilizing the connecting element 64. In accordance with a further feature of the present invention, different spindle cleaning devices 32, or groups thereof, can be arranged to engage their respective spindle base portions 16 during different predetermined portions of the downward bottomwinding movement of the ring rail 20.

As illustrated in FIG. 4, a plurality of flexible links 60, 60' and 60'' are utilized, each having a different predetermined length and each being connected from a different guide rod 24 to a different group of spindle cleaning devices 32. In FIG. 4, the guide rods 24 are illustrated at their lowermost positions (e.g. during bottomwinding), and the tensioned flexible links 60, 60′ and 60″ have predetermined lengths for connection to guide rod brackets 62 arranged at increasingly higher positions on the guide rods 24. Therefore, when bottomwinding has been completed and the ring rail 20 starts its upward movement, the varying lengths of the flexible links 60, 60′ and 60″ will result in the spindle cleaning devices 32 to which they are respectively attached, being pivoted upwardly during different portions of the upward movement of the ring rail 20 and to thereby come into engagement with their respective spindle base portions 16 at different times. Thus, looking at FIG. 4, it will be apparent that upward movement of the guide rods 24 will result in the right hand groups of cleaning devices 32, attached to the shortest flexible link 60″, coming into engagement with its spindle bars portions 16 first, followed thereafter by the group of cleaning devices 32 attached to flexible link 60′ engaging its corresponding spindle base portions 16, and then by the last group attached to the longest flexible link 60 making such engagement. The particular number and lengths of the flexible links 60, 60′ and 60″ may be selected, as desired, to determine the sequence of engagement of the different groups of spindle cleaning devices 32 with their respective spindle base portions 16, and when a large number of groups of spindle cleaning devices 32 are being used, more than one group spaced along the spinning rail 10 can have flexible links of equal length to cause simultaneous engagement of such spaced groups.

By virtue of the foregoing arrangement, it will be apparent that the sequential cleaning of the spindle base portions 16 will result in a corresponding sequential release of "fly" or dust generated by the cleaning engagement of the cleaning elements 38 with the spindle base portions 16, thereby lessening the total quantity of such fly which is generated at any given time. This sequential release of fly makes it more likely that the fly will be adequately controlled by the conventional air cleaning equipment normally associated with a spinning frame, rather than tending to overload the capacity of such air cleaning equipment by simultaneously releasing fly from all of the spindles and generating a substantial quantity of such fly which must be collected at the same time by the air cleaning equipment.

Thus, the embodiment of the present invention illustrated in FIGS. 1-4 provides spindle cleaning devices which are inexpensive and easy to install and operate on existing spinning frames. Moreover, these devices clean the yarn wraps from the spindles immediately after each doffing cycle of the spinning frame to prevent any accumulation of such yarn wraps on the spindles, and the operation of the cleaning devices, by utilizing the movement of the ring rail, is entirely automatic without requiring any labor.

Figure 5B:
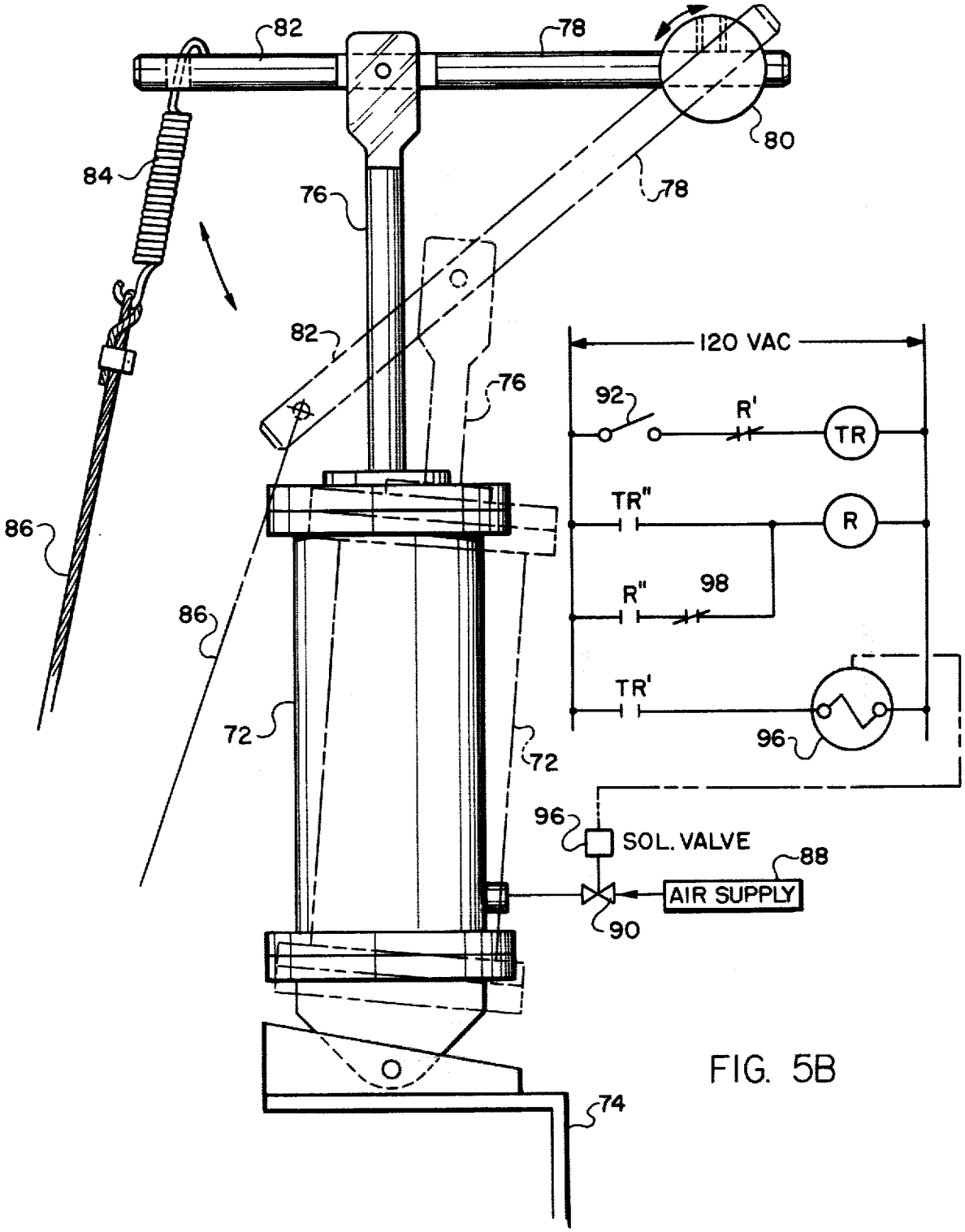

FIGS. 5A and 5B illustrate a second embodiment of the present invention which will have advantages in some applications of the present invention. In the embodiment of FIGS. 1-4 described above, the cleaning elements are maintained in cleaning contact with the spindles during substantially all of the yarn package building cycle, and thorough cleaning of the spindle is obtained. However, the frictional contact and adjustment tolerances between the cleaning elements and the spindles may affect the otherwise constant speed of rotation of the spindles by slowing them down in a regular or erractic manner, particularly in instances where the adjustment of the position of the cleaning element with respect to the spindle, as described above, is not properly made and there is more frictional contact than is necessary or desirable. While this affect on the rotational speed will normally not have any significant adverse effect on the yarn being built into a package, it has been found that in some yarn to be used in certain types of fabric (e.g. corduroy) the non-constant rotational speed of the spindles resulting from the aforesaid contact between the cleaning elements and the spindle may cause a pattern of flaws in the yarn which will show up as a defect in the cloth formed from the yarn. Additionally, the prolonged contact between the cleaning elements and the spindle may, in some instances, result in more wear of the cleaning elements than is desirable.

Accordingly, in the second embodiment of the present invention which is illustrated in FIGS. 5A and 5B, the cleaning elements are normally maintained out of contact with the spindles at a lowered position beneath the lowest point of movement of the ring rail, and an operating arrangement is provided for causing the cleaning elements to be moved to their raised or cleaning position in response to the ring rail reaching a predetermined position in its yarn package building cycle, such cleaning elements being raised to their cleaning position only once during the package building cycle and being maintained there for only a relatively short period of time (e.g. five seconds) sufficient to clean the underwound yarn wraps from the spindle.

Looking at FIG. 5A, the cleaning elements 38 are mounted on the spindle rail 10 in essentially the same manner as that described above, and to the extent that the elements in FIGS. 5A and 5B are identical to the corresponding elements in FIGS. 1-4, they have the same reference numerals. It is to be noted, however, that in FIG. 5A the mounting bracket 44 is secured by bolts 46 to the vertical side wall rather than the horizontal top wall of the spindle rail 10, and the stop 52′ is extended from the supporting frame 34 to contact the top wall of the spindle rail 10 rather than vice versa as in FIGS. 1-4.

As in the first embodiment described above, the supporting frame 34 pivots between a first or raised position (shown in full lines in FIG. 5A) at which the cleaning elements 38 are in cleaning contact with the lower portion 16 of the spindle, and a second or lowered position (shown in dotted lines in FIG. 5A) at which the cleaning elements 38 are disposed at an inactive location beneath the lowest point of movement of the ring rail 20. The operating arrangement for causing this pivotal movement includes a biasing spring 70 secured at one end to a convenient part of the spinning frame structure and at its other end to the element 66 extending from the supporting frame 34, the spring 70 urging the supporting frame 34 toward its second or lowered position. Additionally, a motor 72, such as an air cylinder, is pivotally mounted on the spinning frame, preferably an existing bracket on rail 74, and includes a piston rod 76 extending therefrom for attachment to a first arm 78 that extends from an actuation shaft 80 that is also attached to an existing support surface on the spinning frame, such as the top drafting system support (not shown). A second arm 82 extends from the actuator shaft 80 in spaced parallel relation to the first arm 78, and the extending end of the second arm 82 has attached thereto a spring 84 which, in turn, is connected to one end of a cable 86 that is secured at its other end to extension element 66.

The air motor 72 is operated by any convenient source of pressurized air 88 that is controlled by a two-way solenoid operated valve 90 which at one position causes air to be admitted to the motor 72 and move the piston rod 76 from its retracted position (shown in dotted lines in FIG. 5B) to its extended position (shown in full lines in FIG. 5B), whereby the first arm 78 pivots the actuator shaft 80 and raises the second 80 so as to raise the supporting frame 34 and cleaning element 38 from their second aforesaid position to their first aforesaid position. At the other position of the two-way valve 90, the motor 72 is opened to atmospheric pressure to relieve any pressure acting on the piston rod 76, whereby the spring 70 will move the supporting frame 34 to its second position and the piston rod 76 will be lowered to its retracted position through cable 86, spring 84, and arms 82 and 78.

To control the arm motor 72, a limit switch 92 having an extending switch element 94 is mounted to any convenient portion (not shown) of the spinning frame so that the switch element 94 is disposed in the path of movement of the reciprocating ring rail 20. As is well known in the art, the ring rail 20, in building a yarn package, is caused to reciprocate back and forth along portions of the bobbin 18 in a predetermined stepped pattern to build a yarn package having a desired shape. In the present invention, it is preferred that the limit switch 92 be located substantially at the uppermost limit of movement of the ring rail 20 as illustrated in FIG. 5A so that the limit switch 92 will be actuated by contact between the ring rail 20 and the pivoted switch element 94 at a predetermined position of the ring rail near the top of its aforesaid stepped reciprocating pattern of movement.

A typical electrical current for operating the two-way valve 90 in response to actuation of the limit switch 92 is diagrammatically illustrated in FIG. 5B. When the normally open limit switch 92 is closed, a circuit is completed through normally closed contact R′ and a conventional pneumatic timer-relay TR that is designed to stay in a closed contact condition for any selected predetermined period of time (e.g. five seconds), even after the circuit therethrough is opened, and to thereafter automatically assume an open contact condition. When the circuit through the timer-relay TR is closed by closing limit switch 92, normally opened contacts TR′ and TR″ are closed. The closing of contact TR′ completes a circuit through solenoid 96 which operates the valve 90 to admit air to the air motor 72 and raise the cleaning elements to their raised or first position as described above. When the timer-relay TR reverts to its open contact position after the aforesaid predetermined period of time, the contact TR′ is opened to open the circuit through solenoid 96 whereby the valve 90 then opens the air cylinder 72 to atmosphere pressure to allow the spring 70 to lower the supporting frame 34 and cleaning elements 38 to their lower or second position in the manner described above.

The closing of contact TR″ by timer-relay TR, as set forth above, closes a circuit through relay R which, in turn, closes normally open contact R″ to establish a holding circuit through the normally closed contact 98 of the motor which operates the spinning frame itself. When the yarn package has been completely built on the bobbin 18, the spinning frame motor will automatically stop and contact 98 will open, thereby resetting the entire electrical circuit to its original condition so that the above-described sequence of operation can be repeated during the next yarn package building cycle of the spinning frame. Additionally, the energization of relay R opens normally closed contact R′ so that any further opening or closing of the limit switch 92 by the ring rail 20 will have no effect upon the timer-relay TR until the circuit has been reset as described above.

Thus, the operation of the embodiment illustrated in FIGS. 5A and 5B is as follows. The supporting frame 34 and cleaning elements 38 are normally maintained at their second or inactive lowered position by spring 70, and the ring rail 20 proceeds to build a yarn package on the bobbin 18 in a conventional manner. However, when the ring rail 20, in building the package, reaches a predetermined position as determined by the location of the limit switch 92, the limit switch 92 will be actuated by the ring rail 20 to thereby operate valve 90 to admit air into the air motor 72 which extends piston rod 76 to move the supporting frame 34 to its first or cleaning position with the cleaning elements 38 in contact with the spindle portion 16 to remove underwound wraps therefrom. The supporting frame 34 will remain at this cleaning position for a period of time determined by the setting of timer-relay TR (e.g. five seconds), after which the valve 90 is moved to its atmospheric position to remove any pressure in the air motor 72, and the spring 70 will pull the supporting frame 34 to its original lowered position. Thus, during each yarn package building cycle, the cleaning elements 38 are brought into cleaning contact with the spindle portion 16 and remain there for a relatively short period of time to adequately clean the spindles of underwound wraps, after which they are moved to a lowered position that is below the lowest point of movement of the ring rail 20 even when it reaches its aforesaid abnormally low position during bottomwinding.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. Apparatus for cleaning underwound yarn wraps from a spindle mounted on the spindle rail of a spinning frame having a ring rail reciprocably movable along the axis of said spindle to build a yarn package on a bobbin carried by said spindle, said apparatus including:

(a) a supporting frame;

(b) at least one cleaning element mounted on said supporting frame to extend therefrom for selective cleaning engagement with said spindle; and (c) mounting means associated with said supporting frame and adapted to connect said supporting frame to said spindle rail for pivotal movement between a first position at which said cleaning element engages said spindle for cleaning thereof and a second position at which said supporting frame and said cleaning element are disposed beneath the lowest point of movement of said ring rail.

2. Apparatus for cleaning underwound yarn wraps from a spindle as defined in claim 1, and further characterized in that said apparatus includes operating means for connecting said supporting frame to said ring rail to cause said supporting frame to be moved from said first position thereof to said second position thereof during a predetermined portion of the downward movement of said ring rail.

3. Apparatus for cleaning underwound yarn wraps from a spindle as defined in claim 2 and further characterized in that said operating means includes biasing means for urging said supporting frame toward said first position thereof.

4. Apparatus for cleaning underwound yarn wraps from a spindle as defined in claim 2 and further characterized in that said operating means includes a flexible link means connecting said ring rail to said supporting frame.

5. Apparatus for cleaning underwound yarn wraps from a spindle as defined in claim 1 and further characterized in that said mounting means includes a stop element disposed for abutment with said supporting frame at said first position thereof, said disposition of said stop element being selectively adjustable to thereby vary the position of said supporting frame relative to said spindle at said first position of said supporting frame.

6. Apparatus for cleaning underwound yarn wraps from a spindle as defined in claim 1 or claim 2 and further characterized in that said supporting frame includes at least one arm member extending in generally parallel relation to the axis of said spindle at said first position of said supporting frame, and in that said cleaning element is mounted on said arm member for selectively adjustable movement in a direction transverse to the said spindle axis at said first position of said supporting frame.

7. In combination with a spinning frame having a spinning rail from which a plurality of rotating spindles extend upwardly therefrom along parallel axes and having a vertically reciprocating ring rail means for building yarn packages on bobbins carried on said spindles, the improvement comprising yarn wrap removal apparatus including:

(a) a plurality of spindle cleaning means;

(b) mounting means independently connecting each said spindle cleaning means to said spindle rail for movement between a first position at which each said spindle cleaning means engages at least one of said spindles to clean yarn wraps therefrom and a second position at which each said spindle cleaning means is clear of said ring rail means during said reciprocating movement thereof; and (c) operating means connecting each said spindle cleaning means to said ring rail means, said operating means acting to move each said spindle cleaning means from said first position thereof to said second position thereof during a predetermined portion of movement of said ring rail means in a downward direction and acting to move each said spindle cleaning means from said second position thereof to said first position thereof during a predetermined portion of movement of said ring rail means in an upward direction.

8. The combination defined in claim 7 and further characterized in that said operating means connects each said spindle cleaning means to said ring rail means independently of the other spindle cleaning means, and in that said operating means acts to move at least one of said spindle cleaning means from said second position thereof to said first position thereof during one predetermined portion of said upward ring rail means movement and acts to move at least one other of said spindle cleaning means from said second position thereof to said first position thereof during a different predetermined portion of said upward ring rail means movement.

9. The combination defined in claim 7 and further characterized in that such ring rail means includes a ring rail element and at least one guide bar extending downwardly therefrom and beneath said spindle rail, and in that said operating means includes a flexible link independently connected between the lower portion of said guide bar and each of said spindle cleaning means to move said spindle cleaning means from said first position thereof to said second position thereof.

10. The combination defined in claim 9 and further characterized in that said operating means includes biasing means engaging each said spindle cleaning means for moving said spindle cleaning means from said second position thereof to said first position thereof when slack occurs in said flexible link.

11. The combination defined in claim 10 and further characterized in that said ring rail means includes a plurality of said guide bars spaced along the length of said spinning rail, with each guide bar having one of said flexible links connected thereto and connected to a different one of said spindle cleaning means, and in that the length of at least some of said flexible links is different from the length of some others of said flexible links to permit said biasing means to move different ones of said spindle cleaning means to said first positions thereof during different predetermined portions of said upward movement of said ring rail means.

12. Apparatus for cleaning underwound yarn wraps from a spindle as defined in claim 1, and further characterized in that said apparatus includes operating means for causing said supporting frame to be moved from said second position thereof to said first position thereof in response to said reciprocating ring rail reaching a predetermined position during said building of said yarn package on said bobbin.

13. Apparatus for cleaning underwound yarn wraps from a spindle as defined in claim 12 and further characterized in that said operating means is arranged to cause said supporting frame to be moved from said second position thereof to said first position thereof only once during the yarn package building cycle of said ring rail.

14. Apparatus for cleaning underwound yarn wraps from a spindle as defined in claim 13 and further characterized in that said operating means maintains said supporting frame at said first position thereof for a predetermined period of time, and in that biasing means are connected to said supporting frame for moving said supporting frame from said first position thereof to said second position at the end of said predetermined period of time.

15. Apparatus for cleaning underwound yarn wraps from a spindle as defined in claim 12 and further characterized in that said operating means includes switch means disposed in the path of movement of said ring rail at said predetermined position thereof for actuation by said ring rail as it reaches said predetermined position, and in that said operating means includes motor means connected to said supporting frame and responsive to said actuation of said switch means to move said supporting frame from said second position thereof to said first position thereof.

16. Apparatus for cleaning underwound yarn wraps from a spindle as defined in claim 15 and further characterized in that said motor means includes control means for maintaining said supporting frame at said first position thereof for a predetermined period of time and thereafter to deenergize said motor means.

17. Apparatus for cleaning underwound yarn wraps from a spindle as defined in claim 16 and further characterized in that said operating means includes biasing means for urging said supporting frame toward said second position thereof whereby said supporting frame will be moved to said second position thereof after said deenergization of said motor means.

18. Apparatus for cleaning underwound yarn wraps from a spindle mounted on the spindle rail of a spinning frame having a ring rail reciprocably movable along the axes of said spindle to build a yarn package on a bobbin carried by said spindle, said apparatus including:

(a) a supporting frame, (b) at least one cleaning element mounted on said supporting frame to extend therefrom for selective cleaning engagement with said spindle;

(c) mounting means associated with said supporting frame and adapted to connect said supporting frame to said spinning frame for pivotal movement between a first position at which said cleaning element engages said spindle for cleaning thereof and a second position at which said supporting frame and said cleaning element are disposed beneath the lowest point of movement of said ring rail; and (d) operating means which includes switch means located in the path of movement of said ring rail for actuation thereby when said ring rail reaches a predetermined position, motor means connected to said supporting frame and selectively energized by said actuation of said switch means to move said supporting frame from said second position thereof to said first position thereof and to maintain said supporting frame at said first position thereof for a predetermined period of time, and biasing means connected to said supporting frame to move said supporting frame from said first position thereof to said second position thereof at the end of said predetermined period of time.

* * * * *